US007290597B2

(12) United States Patent
Takano

(10) Patent No.: US 7,290,597 B2
(45) Date of Patent: Nov. 6, 2007

(54) HEAT EXCHANGER

(75) Inventor: Akihiko Takano, Konan (JP)

(73) Assignee: Valeo Thermal Systems Japan Corporation, Saitama (JP)

( * ) Notice: Subject to any disclaimer, the term of this patent is extended or adjusted under 35 U.S.C. 154(b) by 0 days.

(21) Appl. No.: 10/584,621

(22) PCT Filed: Oct. 27, 2004

(86) PCT No.: PCT/JP2004/015924

§ 371 (c)(1),
(2), (4) Date: Jun. 26, 2006

(87) PCT Pub. No.: WO2005/066567

PCT Pub. Date: Jul. 21, 2005

(65) Prior Publication Data

US 2007/0144719 A1 Jun. 28, 2007

(30) Foreign Application Priority Data

Dec. 26, 2003 (JP) ..... 2003-431887

(51) Int. Cl.
*F28F 9/02* (2006.01)
*F28D 1/02* (2006.01)

(52) U.S. Cl. ..... 165/173; 165/175; 165/176

(58) Field of Classification Search ..... 165/173, 165/175, 176, 177, 153
See application file for complete search history.

(56) References Cited

U.S. PATENT DOCUMENTS

| | | | | |
|---|---|---|---|---|
| 3,416,600 | A * | 12/1968 | Fink | 165/175 |
| 5,314,013 | A * | 5/1994 | Tanabe | 165/176 |
| 6,170,569 | B1 * | 1/2001 | Dienhart et al. | 165/173 |
| 6,523,606 | B1 * | 2/2003 | Dienhart et al. | 165/144 |
| 6,546,999 | B1 * | 4/2003 | Dienhart et al. | 165/150 |
| 2006/0048928 | A1 * | 3/2006 | Maezawa et al. | 165/173 |
| 2006/0124288 | A1 * | 6/2006 | Demuth et al. | 165/175 |

FOREIGN PATENT DOCUMENTS

| | | |
|---|---|---|
| JP | 2002-521644 | 7/2002 |
| WO | 00/06964 | 2/2000 |

* cited by examiner

*Primary Examiner*—Tho Duong
(74) *Attorney, Agent, or Firm*—Wenderoth, Lind & Ponack, L.L.P.

(57) ABSTRACT

An object of the present invention is to provide a specific relationship to be achieved by numerical values selected to sustain a desired level of coolant distributability as well as miniaturization and weight reduction for tanks in a heat exchanger adopting a structure in which the width of tubes therein is set smaller relative to the inner diameter of the tanks. In the heat exchanger according to the present invention, the inner diameter of the tanks is set small relative to the tube width, and with Dt representing an equivalent diameter at the passage section of the tanks and L representing the length of the longest path extending from an entrance to an open end of a tube, $15 \leqq L/Dt \leqq 42$ is true.

7 Claims, 5 Drawing Sheets

L=LENGTH OF LONGEST PATH RANGING FROM COOLANT ENTRANCE TO TUBE OPENING

Dt=EQUIVALENT DIAMETER AT TANK SECTION

COOLANT DISTRIBUTABILITY=
LOWEST TUBE FLOW RATE/HIGHEST TUBE FLOW RATE

HEAT EXCHANGER

TECHNICAL FIELD

The present invention relates to a heat exchanger that includes a pair of tanks made to communicate with a plurality of tubes and constitutes part of a refrigerating cycle and, more specifically, a refrigerating cycle in which a high-pressure coolant is used.

BACKGROUND ART

A heat exchanger with a pair of tanks made to communicate with each other via a plurality of flat tubes is often used as a condenser that cools a high-pressure coolant. Heat exchangers used in such applications in the known art include those adopting a junction structure whereby the ends of the flat tubes are inserted and brazed at tube insertion holes formed at the tanks with the openings of the tube insertion holes extending along the direction of the radius of the tanks so as to allow the surfaces of the flat tubes with a relatively large area to turn toward the adjacent tubes (see, for instance, patent reference literature 1 and 2). In this structure, the inner diameter of the tanks is set equal to or greater than the width of the tubes along the direction in which the tank axes extend (hereafter referred to as the tube width).

A heat exchanger with the inner diameter of the tanks thereof set equal to or greater than the tube width as described above, may be used in conjunction with a high-pressure coolant such as $CO_2$. In such a case, the wall thickness of the side walls of the tanks must be increased to assure greater strength which, in turn, results in a relative increase in the external dimensions of the tanks. This ultimately leads to a problem in that the heat exchanger becomes unnecessarily large and heavy.

The problem described above is addressed in a structure that includes communicating portions as well as a distribution area ranging along the axial direction relative to the tanks with the communicating portions each assuming a shape gradually widening, starting from the distribution area toward the tube insertion hole until its width becomes substantially equal to the tube width, so as to allow the tanks to assume a smaller inner diameter at the distribution areas thereof relative to the tube width, as disclosed in patent reference literature 3.

Patent reference literature 1: Japanese Unexamined Patent Publication No. H8-145591

Patent reference literature 2: Japanese Unexamined Patent Publication No. 2001-133076

Patent reference literature 3: Japanese Unexamined Patent Publication No. 2003-314987

DISCLOSURE OF THE INVENTION

Problems to be Solved by the Invention

However, in the structure disclosed in patent reference literature 3, the communicating passages are likely to act as restricters while the coolant flows from the tubes to a distribution area via the communicating portions. In addition, the sectional area of the flow passage is relatively small. These factors give rise to a concern that the coolant flow may concentrate substantially at a single point, and a flow passage resistance may occur since the coolant does not flow smoothly into the distribution area, resulting in poor coolant distribution and ultimately the efficiency of the heat exchanger may be compromised.

Namely, an optimal heat exchanger cannot be achieved simply by using tanks with a smaller internal diameter relative to the tube width, since the excessively small diameter and the excessively light weight of the tanks may lead to poor coolant distribution, which, in turn, lowers the heat exchanger efficiency.

Accordingly, an object of the present invention is to provide a specific relationship to be achieved by numerical values set with regard to a heat exchanger so as to assure a desired level of coolant distributability as well as reductions in both the bulk and weight of tanks the internal diameter of which is set smaller relative to the tube width.

The heat exchanger according to the present invention, comprising a pair of tanks, a plurality of tubes disposed between the pair of tanks and fins disposed between the tubes, with the pair of tanks made to communicate with each other via the tubes having open ends on the two sides thereof along the length of the tubes inserted at insertion holes formed at the tanks and the width of a specific area of the tubes along the axes of the tanks set greater than an equivalent diameter of the tanks corresponding to a tank passage section, is characterized in that $15 \leqq L/Dt \leqq 42$ is true with Dt representing the equivalent diameter corresponding to the tank passage section and L representing the length of the longest path ranging from a coolant entrance to the open end of a tube. The specific area of the tubes along the direction of the tank axes includes a central portion of each tube along the length thereof where the width along the direction of the tank axes is greater than the width along the direction of airflow and open end portions on the two sides where the width along the direction of airflow is greater than the width along the direction of the tank axes if the tubes adopt a twisted structure.

The heat exchanger according to the present invention is further characterized in that with S representing the flow passage area inside the tanks, $20\ mm^2 \leqq S \leqq 50\ mm^2$ is true. The heat exchanger according to the present invention is also characterized in that with S representing the flow passage area inside the tanks, P representing the length of the inner circumference of the tanks and Sc representing the area of the circle with the circumference P, $S \geqq Sc \times 0.7$ is true. The tubes adopt a twisted structure so that the width along the direction of the tank axes is greater than the width along the direction of airflow over the central areas of the tubes along the length thereof and the width along the direction of airflow is greater than the width along the direction of the tank axes at the tube openings on the two sides thereof.

EFFECT OF THE INVENTION

The present invention provides a specific relationship to be achieved so as to assure superior coolant distributability as well as a reduction in the external dimensions of the tanks and a reduction in the weight of tanks in a heat exchanger equipped with the tanks the inner diameter of which is set smaller relative to the tube width.

By adopting the present invention, tanks with a flow passage area assuring a desired level of resistance to pressure damage and a desired level of pressure withstanding performance are provided.

The present invention allows the openings at the tube insertion holes formed at the tanks to assume a shape whereby the width along the axial direction is greater than the width along the radius of the tanks. Thus, the width of the tubes over the central areas thereof along the direction of the tank axes can be set greater than the inner width along the radius of the tank. Namely, even as the inner widths of the inflow chamber and the outflow chamber of the tanks are reduced to allow the tanks to assume a relatively large wall thickness at the side surfaces thereof without increasing the external dimensions in order to accommodate the use of a high-pressure coolant such as a $CO_2$ coolant and the tank dimensions are set accordingly, the width of the tubes over the central areas thereof along the tank axes remains unaffected. As a result, the tubes are allowed to retain dimensions that will minimize the passage resistance (pressure damage rate) when the coolant passes through the coolant passage.

DETAILED DESCRIPTION OF THE INVENTION

An embodiment of the present invention is now explained with reference to the drawings.

Figure 1A:
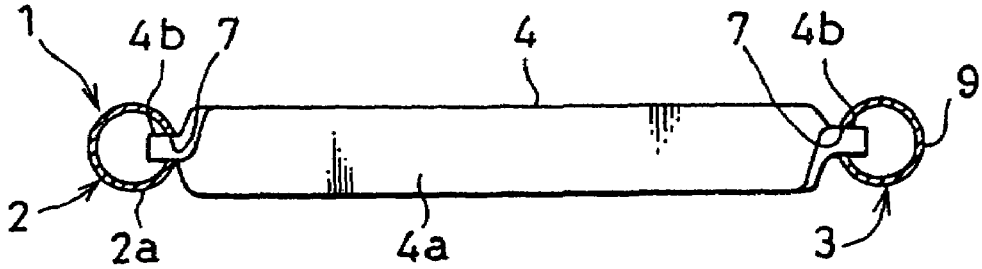
FIGS. 1(*a*) and 1(*b*) schematically show the structure adopted in the heat exchanger according to the present invention, with FIG. 1(*a*) presenting a schematic sectional view of the heat exchanger from the top and FIG. 1(*b*) presenting a schematic sectional view of the heat exchanger from the front.
Figure 1B:
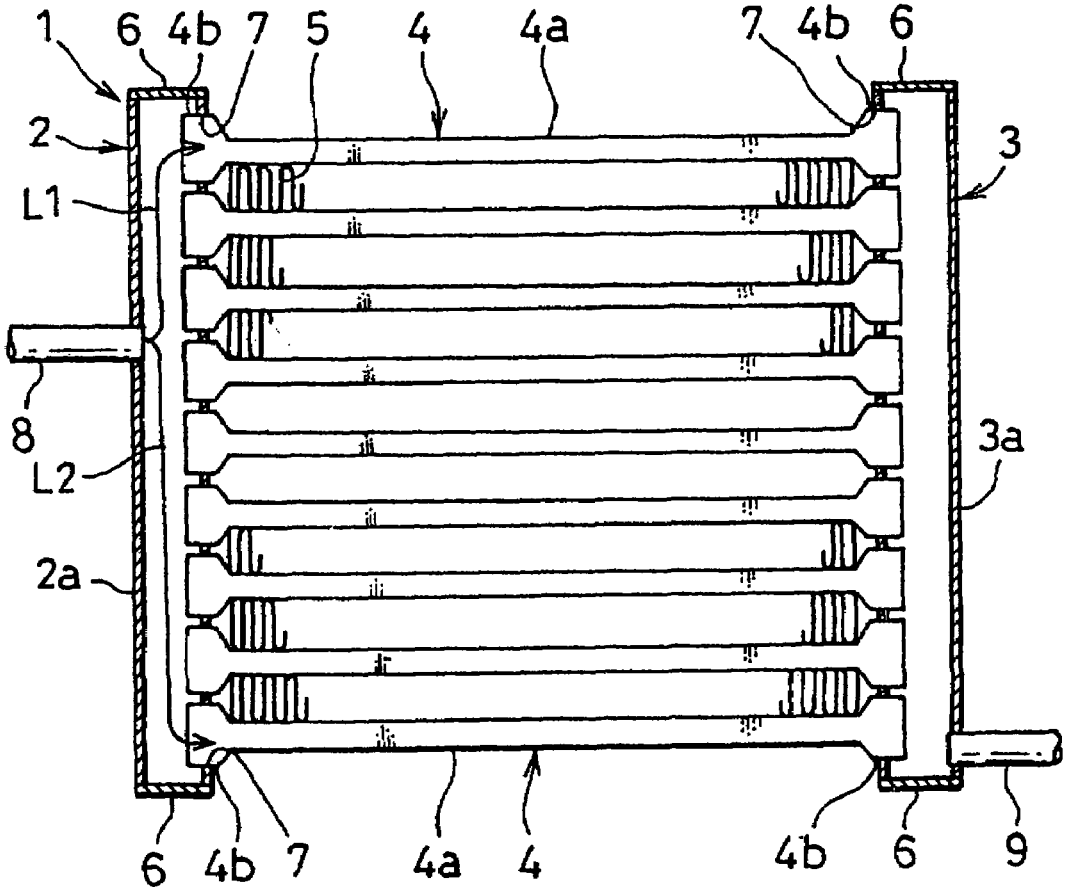

A heat exchanger 1 shown in FIGS. 1(*a*) through 4 may be used as a condenser constituting part of a refrigerating cycle in, for instance, an automotive air-conditioning system, in which a high-pressure coolant such as $CO_2$ is used. The heat exchanger 1 includes a pair of tanks 2 and 3, a plurality of tubes 4 communicating between the pair of tanks 2 and 3 and corrugated fins 5 inserted and bonded between the tubes 4. In the heat exchanger 1 adopting a standard structure, the tanks 2 and 3 are disposed so as to range from top to bottom as shown in FIG. 1(*b*) and thus, air flowing perpendicular to the drawing sheet passes through the fins 5.

The tanks 2 and 3 respectively include header main units 2*a* and 3*a* formed by extruding an aluminum material clad with a brazing material into tubular shapes with the openings at the ends of the header main units 2*a* and 3*a* on the two sides closed off with lids 6. Numerous insertion holes 7 into which the tubes 4 are inserted are formed along the lengths of the tanks. It is to be noted that the specific shape of the tube insertion holes 7 is to be described later. In addition, since a high-pressure coolant such as $CO_2$ is used in the heat exchanger, the wall thickness of the header main units 2*a* and 3*a* in the tanks 2 and 3 is set relatively large compared to the wall thickness of conventional tanks. Furthermore, an intake portion 8 through which the heat exchanging medium, i.e., the coolant, flows in is formed at one of the tanks, i.e., the tank 2, and an outlet portion 9 through which the coolant flows out is formed at the other tank 3 in the embodiment.

It is to be noted that although not shown, the heat exchanger 1 constituted with the tubes 4 and the fins 5 layered alternately to each other may include end plates fixed between the tanks 2 and 3 at the two ends of the layered tube/fin assembly.

Accordingly, the coolant having flowed in through the intake portion 8 enters the tank 2 on the upstream side thereof, flows through the tank 2 along the axial direction, moves into the tank 3 from the tank 2 via the tubes 4, flows through the tank 3 along the axial direction to reach the downstream end thereof and then flows out via the outlet portion 9. In other words, the coolant flowing into the heat exchanger used as a condenser, having been compressed at a compressor in the refrigerating cycle, is a high-temperature and high-pressure coolant. It passes through the tubes 4, releases heat as it exchanges heat with the air passing through the fins 5 and thus becomes a relatively low-temperature, low-pressure coolant.

Figure 2:
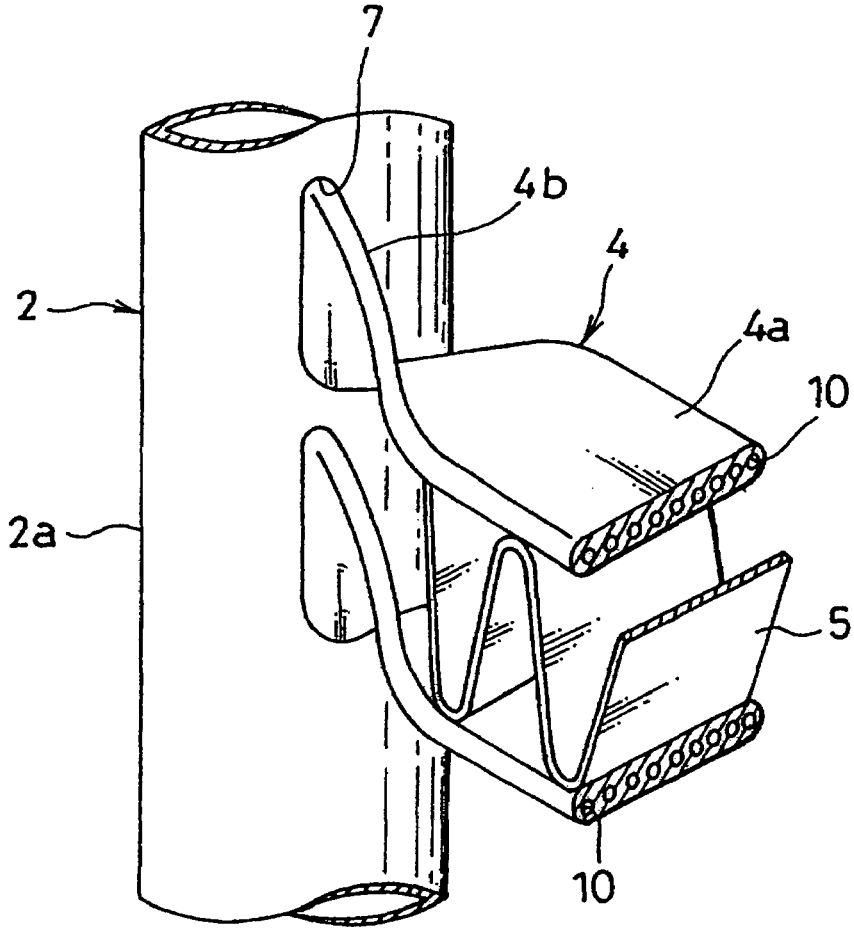
FIG. 2 is an enlarged perspective showing an essential structure adopted in the heat exchanger over the area where the tube connects with the tank.
Figure 3:
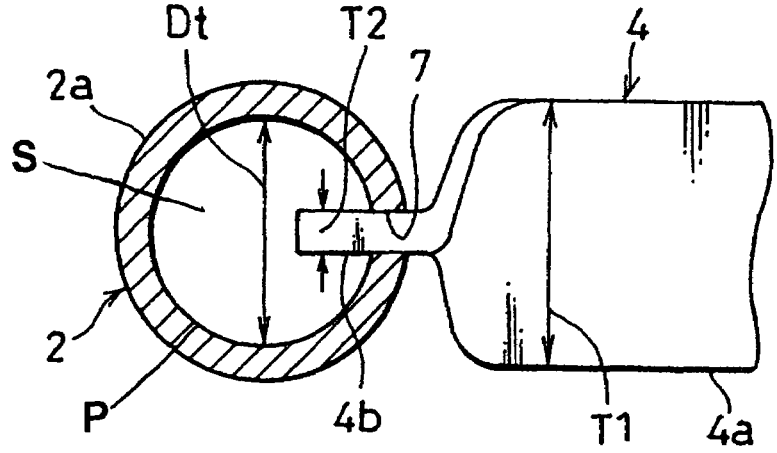
FIG. 3 is a section of the heat exchanger over the area where the tube connects with the tank, viewed along the direction of the tank axis.
Figure 4:
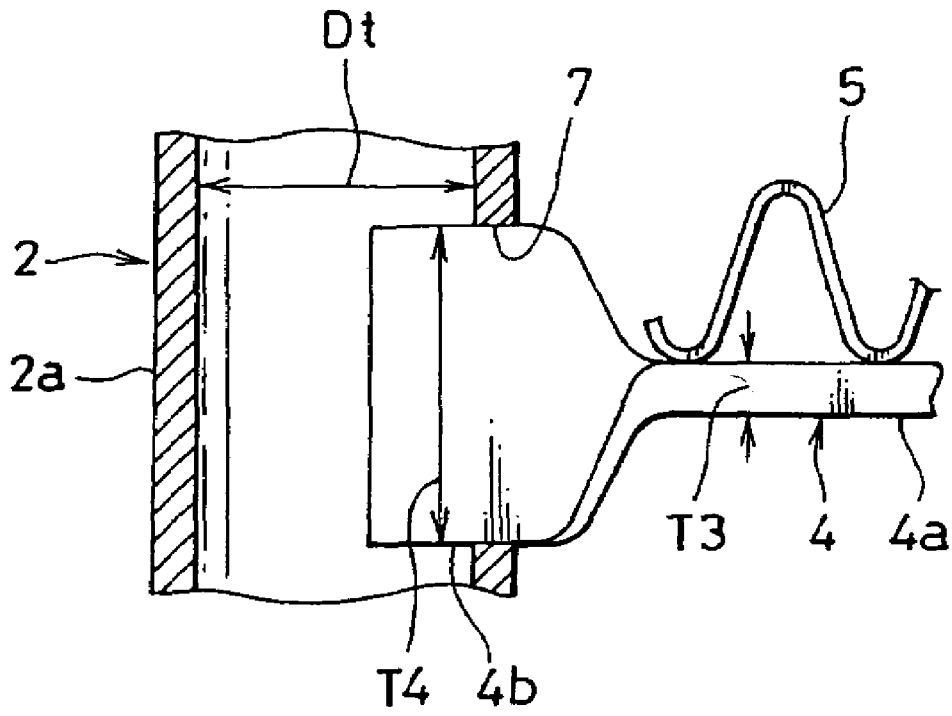
FIG. 4 is a section of the heat exchanger over the area where the tube connects with the tank, viewed along the direction of airflow.

In order to allow the use of a high-pressure coolant such as $CO_2$, the tubes 4 are formed through extrusion and have a distinct feature shown in FIG. 2, i.e., a plurality of coolant passages 10 with, for instance, a circular section formed parallel therein so as to range from the open end on one side toward the other open end. As shown in FIGS. 3 and 4, while each tube 4 assumes a flat shape over its central area 4*a* with the width T1 along the direction of airflow set greater than the width T3 along the tank axis, it assumes a flat shape over an open end area 4*b* including an open end and its vicinity with the width T4 along the tank axis set greater than the width T2 along the direction of airflow. It is to be noted that the width T1 is substantially equal to the width T4 and that the width T2 is substantially equal to the width T3. Such differences between the widths T1 and T3 and between the widths T2 and T4 in the tube 4 are created by, for instance, twisting the open end area 4*b* relative to the central area 4*a* of the tube by approximately 90° through post-processing, as shown in FIG. 2.

This structure allows the openings at the tube insertion holes 7 formed at the tanks 2 and 3, too, to assume a shape whereby their width along the axial direction is greater than their width along the radial direction, and thus, the width T1 over the central area 4*a* and the width T4 over the open end areas 4*b* at the tube 4 can be set greater than an equivalent diameter Dt of the passage section at the tanks 2 and 3, as shown in FIGS. 3 and 4. Namely, even as the inner widths of the inflow chamber and the outflow chamber of the tanks 2 and 3 are reduced to allow the tanks 2 and 3 to assume a relatively large wall thickness at the side surfaces thereof without increasing the external dimensions in order to accommodate the use of a high-pressure coolant such as a $CO_2$ coolant and the tank dimensions are set accordingly, the width T1 of the tubes 4 over the central areas 4*a* and the width T4 over the open end areas 4*b* at the tubes 4 remain unaffected. As a result, the tubes 4 are allowed to retain widths T1 and T4 that will minimize the passage resistance (pressure damage rate) when the coolant passes through the coolant passages 10.

The optimal design values that should be selected with regard to the dimensions of the tanks 2 and 3 used in conjunction with a high-pressure coolant such as $CO_2$ are as follows.

Figure 5A:
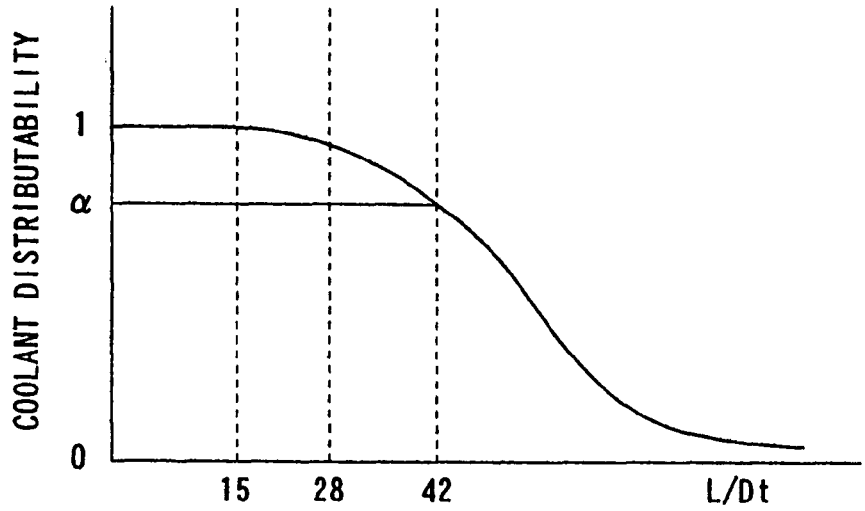
FIGS. 5(*a*) and 5(*b*) are characteristics diagrams over a specific range of numerical values to be assumed, determined by dividing the length of the longest path ranging from the coolant entrance to the opening of a tube by the equivalent diameter corresponding to the tank section in the heat exchanger.
Figure 5B:
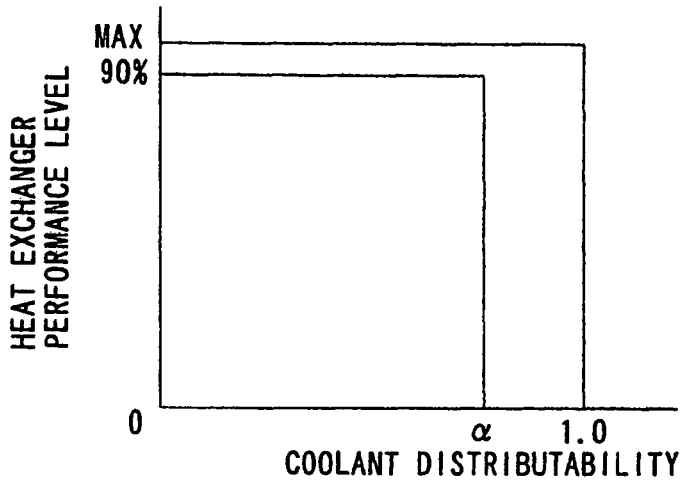

First, a coolant distribution ratio is calculated by dividing the lowest tube flow rate by the highest tube flow rate. A characteristics diagram is shown in FIG. 5(*b*), with the coolant distribution ratio thus calculated indicated along the horizontal axis and the performance level of the heat exchanger 1 indicated along the vertical axis. The coolant distribution ratio achieved when the performance of the heat exchanger 1 is at the maximum level is set to 1.0, and the characteristics curve forms a gentle circular arc in the upper chord and rising toward the right hand side. The characteristics diagram indicates that the numerical value indicating the coolant distribution ratio achieved when the minimum allowable performance level of the heat exchanger 1 is set to 90% of the maximum performance level, is α.

Next, a characteristics diagram with the coolant distribution ratio indicated along the vertical axis and the value calculated by dividing L (representing the distance ranging from an end of the intake portion 8 constituting a coolant entrance to the openings at the individual tubes 4) by Dt (representing the equivalent diameter at the passage section at the tanks 2 and 3) indicated along the horizontal axis, is obtained. With L1 representing the largest length of the path extending from the open end of the entrance portion 8 to the opening at the tube 4 at the uppermost position along the layering direction and L2 representing the length of the path extending from the open end of the intake portion 8 to the open end of the tube 4 at the lowermost position along the layering direction, the numerical value representing L2 is used as the L value described above if the numerical value L2 is greater than the numerical value L1 in the structure shown in FIG. 1 with the intake portion 8 disposed at a midpoint of the tank 2 along the axial direction. As a result, a characteristics diagram shown in FIG. 5(*a*) with the characteristics curve gently descending toward the right side to a specific point and then dropping relatively sharply toward the right hand side is obtained. This characteristics diagram indicates that the numerical value representing L/Dt is 42 when the coolant distribution ratio is α. While the numerical value representing L/Dt is in the range of 1~15 when the coolant distribution ratio is 1, the largest value of L/Dt corresponding to the coolant distribution ratio of 1 is 15 and the values smaller than 15 do not need to be taken into consideration in this process since the coolant distribution ratio remains unchanged at 1. Thus, the numerical value 15 is made to correlate with the coolant distribution ratio 1.

The characteristics determined as described above lead to the conclusion that in order to assure the desired level of coolant distributability as well as reductions in the external dimensions and the weight of the tanks 2 and 3, L representing the length of the longest path from the open end of the intake portion 8 to the opening of the tube 4 disposed at the uppermost position along the layering direction and Dt representing the equivalent diameter corresponding to the inner widths of the inflow chamber and the outflow chamber at the tanks 2 and 3 should assume values relative to each other that will set the numerical value representing L/Dt within a range of 15~42.

Figure 6:
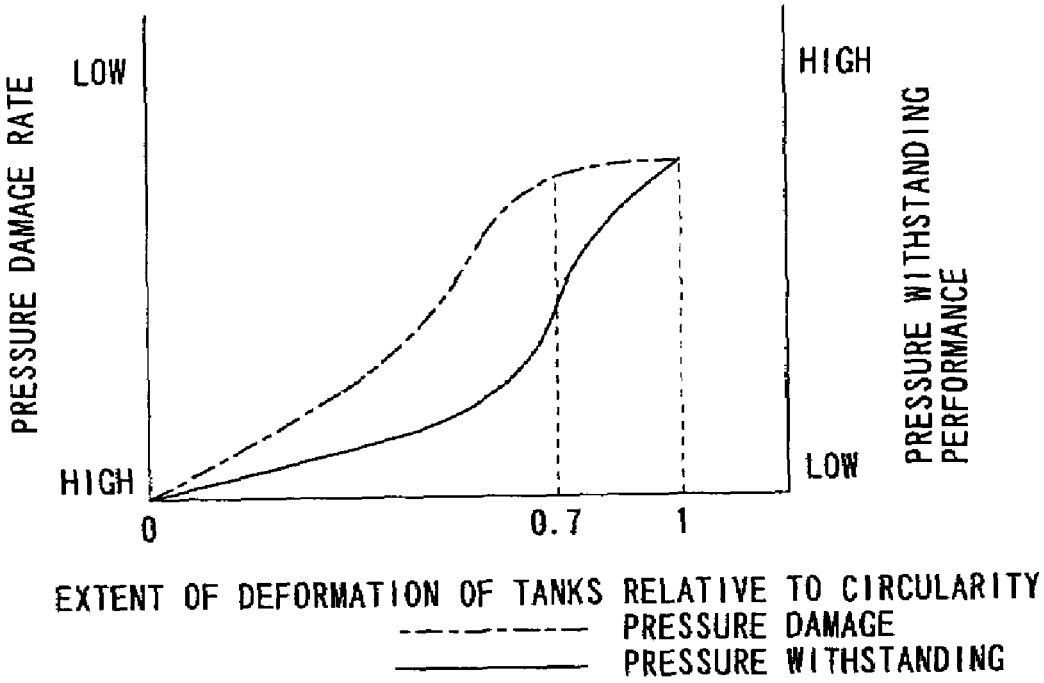
FIG. 6 is a characteristics diagram indicating the extent of deformation of the tanks in the heat exchanger relative to circularity as an allowable value with regard to the pressure damage rate and pressure withstanding performance.

In addition, while shapes of the tanks 2 and 3 do not need to achieve perfect circularity (true circle), the flow passage areas at the inflow passages and the outflow passages in the tanks 2 and 3 gradually become smaller and thus, the passage resistance (pressure damage rate) occurring as the high pressure coolant such as $CO_2$ flows through the tanks 2 and 3 becomes relatively high as indicated by the one-point chain line in FIG. 6 as the tanks 2 and 3 become further deformed relative to true circularity. At the same time, as indicated by the solid line in FIG. 6, the pressure withstanding performance of the tanks 2 and 3 against the high-pressure applied by the high-pressure coolant such as $CO_2$, becomes lowered as the tanks 2 and 3 become further deformed relative to true circularity. Accordingly, it is ascertained based upon the two characteristics curves in FIG. 6 that the value representing the extent of deformation of the tanks 2 and 3 relative to true circularity should not be any less than 0.7 relative to 1 representing true circularity so as to assure the minimum level of pressure withstanding performance and a minimum level of resistance to pressure damage at the tanks 2 and 3.

It is desirable that with P representing a specific value indicating the length of the inner circumference at the tanks 2 and 3, Sc representing the area of the circle with the circumference P and S representing the flow passage area in the tanks 2 and 3, the flow passage area S in the tanks 2 and 3 be equal to or greater than the value obtained by multiplying the flow passage area Sc of a circular passage with the matching circumference P by 0.7. It is also desirable that S assume a value greater than 20 $mm^2$ and smaller than 50 $mm^2$.

It is to be noted that while an explanation is given above with reference to the embodiment that the tubes 4 adopt a twisted structure, the present invention is not limited to this example and the relationship explained above can be achieved by the individual numerical values as long as the width T1 (T4) of the tubes 4 is greater than the equivalent diameter Dt at the passage section of the tanks.

The invention claimed is:

1. A heat exchanger comprising:

a pair of tanks;

a plurality of tubes disposed between said pair of tanks; and fins disposed between said tubes, with said pair of tanks made to communicate with each other via said tubes having open ends on the two sides thereof along the length of said tubes inserted at insertion holes formed at said tanks and the respective widths of specific areas of said tubes along the axes of said tanks set greater than an equivalent diameter of each of said tanks at a passage section thereof, wherein $15 \leqq L/Dt \leqq 42$ is true with Dt representing the equivalent diameter at said passage section of each of said tanks and L representing the length of a longest path ranging from a coolant entrance to the open end of each of said tubes.

2. A heat exchanger according to claim 1, wherein with S representing the flow passage area inside each of said tanks, $20\ mm^2 \leqq S \leqq 50\ mm^2$ is true.

3. A heat exchanger according to claim 1, wherein with S representing the flow passage area inside each of said tanks, P representing the length of the inner circumference of each of said tanks and Sc representing the area of a circle with the circumference P, $S \geqq Sc \times 0.7$ is true.

4. A heat exchanger according to claim 1, wherein said tubes adopt a twisted structure so that the width along the direction of airflow is greater than the width along the axes of said tanks over central areas of said tubes along the length thereof and the width along the axes of said tanks is greater than the width along the direction of airflow at tube openings on the two sides thereof.

5. A heat exchanger according to claim 2, wherein with S representing the flow passage area inside each of said tanks, P representing the length of the inner circumference of each of said tanks and Sc representing the area of a circle with the circumference P, $S \geqq Sc \times 0.7$ is true.

6. A heat exchanger according to claim 2, wherein said tubes adopt a twisted structure so that the width along the direction of airflow is greater than the width along the axes of said tanks over central areas of said tubes along the length thereof and the width along the axes of said tanks is greater than the width along the direction of airflow at tube openings on the two sides thereof.

7. A heat exchanger according to claim 3, wherein said tubes adopt a twisted structure so that the width along the direction of airflow is greater than the width along the axes of said tanks over central areas of said tubes along the length thereof and the width along the axes of said tanks is greater than the width along the direction of airflow at tube openings on the two sides thereof.

* * * * *